United States Patent [19]

Katou et al.

[11] 4,288,684

[45] Sep. 8, 1981

[54] ELECTRODE TYPE STEAM VAPORIZER

[76] Inventors: Hisao Katou; Yoshiya Sakata, both of c/o TDK Electronics Co., Ltd., 14-6, Uchikanda 2-chome, Chiyoda-ku, Tokyo, Japan

[21] Appl. No.: 880,981

[22] Filed: Feb. 24, 1978

[30] Foreign Application Priority Data

Oct. 18, 1977 [JP] Japan ..... 52/138713[U]
Oct. 18, 1977 [JP] Japan ..... 52/138714[U]
Oct. 22, 1977 [JP] Japan ..... 52/127161

[51] Int. Cl.[3] ..... H05B 3/60; F22B 1/30

[52] U.S. Cl. ..... 219/295; 219/273; 219/275; 219/437; 219/541; 261/142; 264/68; 339/36; 339/58

[58] Field of Search ..... 219/271-276, 219/284-295, 437, 541; 339/36, 58; 261/142

[56] References Cited

U.S. PATENT DOCUMENTS

| | | | |
|---|---|---|---|
| 1,603,425 | 10/1926 | Steere | 219/437 |
| 1,782,069 | 11/1930 | Henning | 219/295 X |
| 1,797,457 | 3/1931 | Weiss | 219/272 X |
| 1,806,729 | 5/1931 | Aitken | 219/273 |
| 2,140,516 | 12/1938 | Cowan | 219/274 |
| 2,152,122 | 3/1939 | Wilcox | 219/288 |
| 3,084,614 | 4/1963 | Blanding et al. | 219/437 X |
| 3,308,267 | 3/1967 | Fenstermaker | 219/290 |
| 3,480,001 | 11/1969 | Katzman et al. | 219/271 X |
| 3,518,409 | 6/1970 | Corbett | 219/271 |
| 3,579,263 | 5/1972 | Corbett et al. | 219/295 |
| 3,637,978 | 1/1972 | Corbett et al. | 219/284 |

*Primary Examiner*—A. Bartis
*Attorney, Agent, or Firm*—Oblon, Fisher, Spivak, McClelland & Maier

[57] ABSTRACT

The top surface of an electrode type vaporizer water container has a water inlet covered by a safety cover having an apertured concave portion through which the terminal pins of the electrodes are exposed. A detachable electric power source connector is insertable into the concave portion for engagement with the terminal pins for supplying power to the electrodes. A stopper pin on the connector cooperates with a stopper projection on the container adjacent the terminal pins to prevent the engagement between the connector and pins unless the cover, which as provided with a stopper pin release means, is properly positioned on the container. The engagement of the connector with the terminal pins locks the safety cover in position on the container making it impossible to remove the cover while the connector is so engaged. The safety cover arrangement prevents the supply of water into the container through the inlet with the electrodes electrically energized. The steam nozzle of the vaporizer projects through the cover and includes a convex upper edge which prevents blockage of the nozzle by a planar object laid thereon. The steam nozzle includes a concave part having steam outlets in the bottom wall thereof so arranged that an object dropped into the nozzle will not block the outlets. Projections are provided at the steam outlets to permit condensed water to drain rather than clogging the outlets.

7 Claims, 15 Drawing Figures

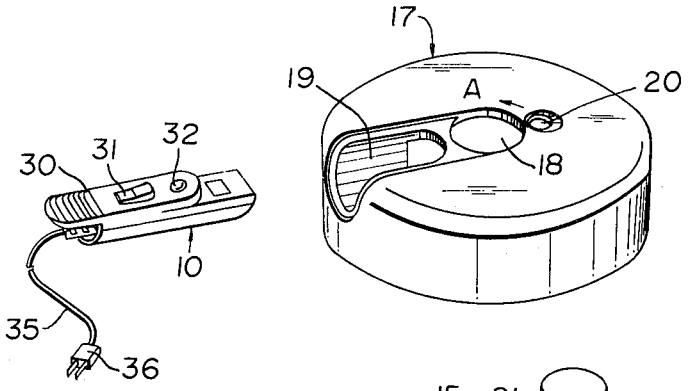
FIG. 1
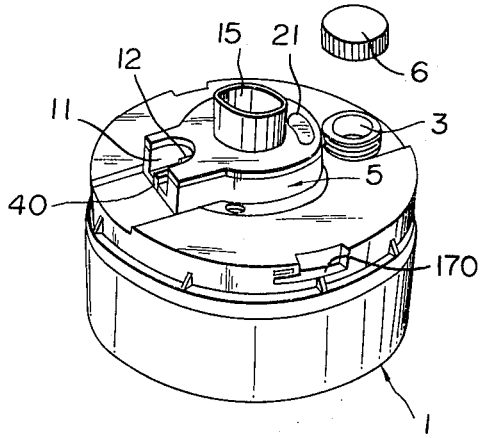
FIG. 2
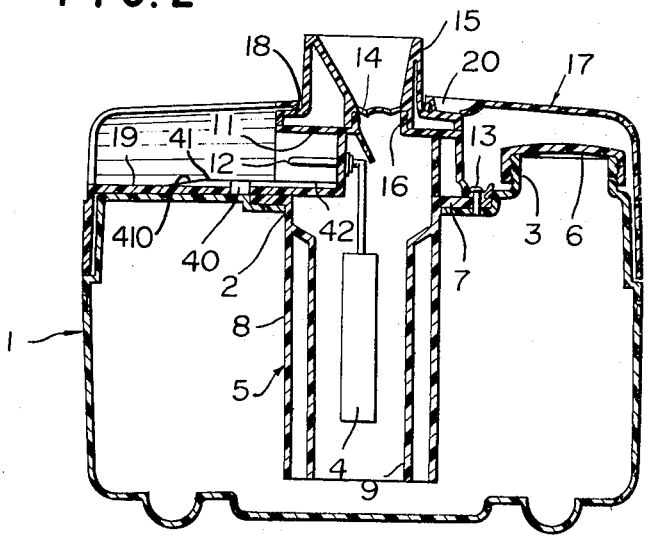

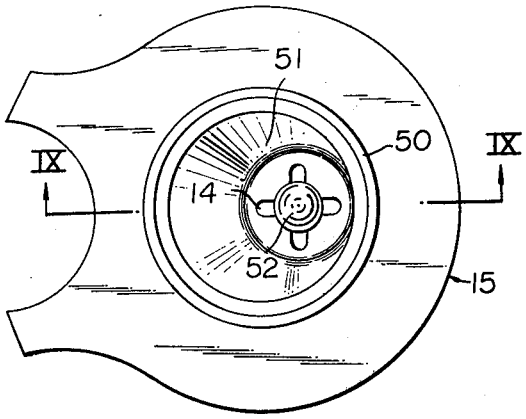
FIG. 8
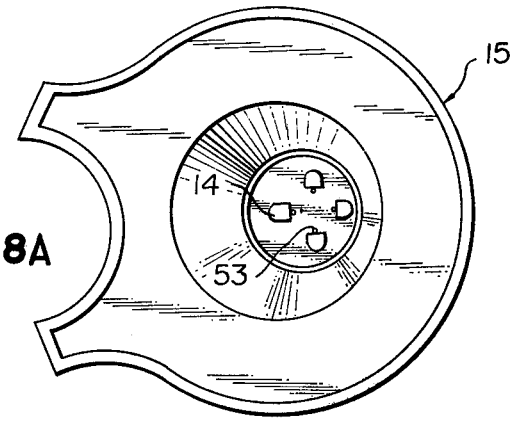
FIG. 8A
FIG. 9
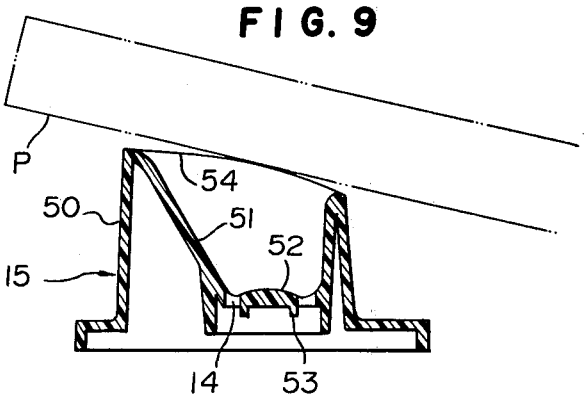

FIG. 10
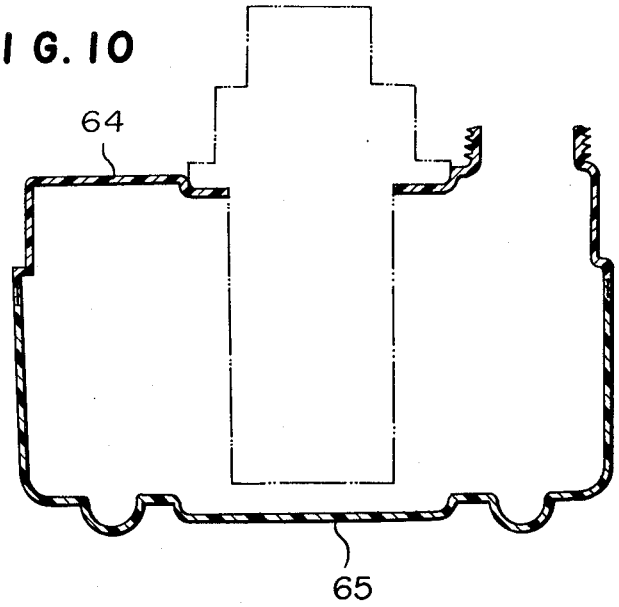
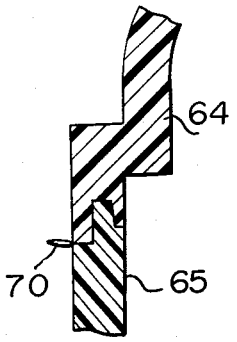
FIG. 11
PRIOR ART
FIG. 12
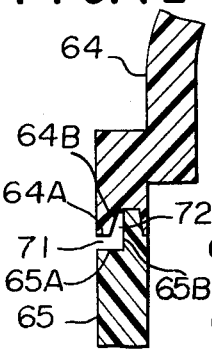
FIG. 13
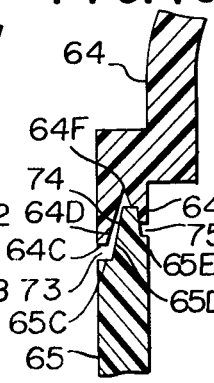
FIG. 14
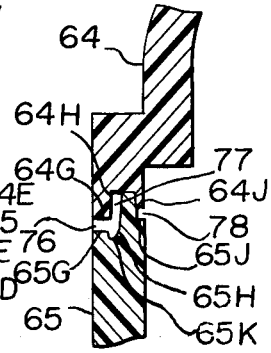

ELECTRODE TYPE STEAM VAPORIZER

BACKGROUND OF THE INVENTION

1. Field of the invention:

The present invention relates to an electrode type steam vaporizer. More particularly, it relates to an electrode type steam vaporizer having an improved structure for preventing an electric shock at the time of feeding water, and an improved steam nozzle structure.

2. Description of the Prior Art:

In general, the electrode type steam vaporizer comprises a pair of electrodes in a container body as a water receptacle to heat water around the electrodes by passing current to the electrodes and vaporizing steam through a steam outlet of the container.

In the conventional electrode type steam vaporizers, electrodes made of graphite or stainless steel have been used. The surfaces of the electrodes have been corroded by a chemical reaction depositing an impurity thereon whereby it is necessary to disassemble and clean the surfaces of the electrodes after about ten days in normal use. Accordingly, in the conventional electrode type steam vaporizers, an electrode unit or an electrode heater unit has been assembled by securing the electrodes in a cylindrical housing having an opening and the unit is assembled in a container so as to be capable of assembly or disassembly by a simple hand operation such as a turning operation or a sliding operation. Water is fed into the container after disassembling the electrode unit through the aperture for connection of the electrode unit. However, when the electrode unit is easily disassembled and exposed by taking it out from the container, a child may disassemble the electrode unit as a play toy and break the electrode plates. If the electrode unit is disassembled from the container when connected to a power source, an accidental electric shock may happen.

When the electrode unit is disassembled from the container for feeding water into the container, water on the electrode surface may fall to cause a stain. The conventional electrode type steam vaporizer is convenient for disassembling the electrode unit for the cleaning of the electrode plates, however, there are various disadvantages as described above.

When the steam vaporizer is used only for few times or the corrosion of the surfaces of the electrodes is not substantial it is seldom necessary to clean the electrodes whereby the simplicity of assembly and disassembly of the electrode unit is not an important consideration.

When the electrodes are not corrosive, such as ferrite electrodes, it is enough to clean them once in six months under normal usage. In such a case, it is advantageous to have a structure wherein the electrode unit is fixed to the container body and the connection of the electrode unit and the water inlet are separately formed and water is fed through the water inlet. However, in such structure, it is dangerous to feed water while passing a current because the accident of electric shock may be caused. Accordingly, it is necessary to consider a safety structure.

The electrode type steam vaporizers are mainly used in home, whereby it is preferable to have a structure for preventing any accident caused by erroneous use. When an opening of a steam nozzle blocked, the steam pressure in the electrode type steam vaporizer may be abnormally increased whereby the steam vaporizer may be broken or hot water may be spread or high pressure steam may be abnormally discharged. It is necessary to consider the possibility of these accidents for safety reasons.

On the other hand, the emitted steam is cooled by the atmospheric condition at the steam outlet and is condensed as water drops and a water film may be formed by the surface tension of the water drops thereby closing the steam outlet. When the steam outlet is closed by the water film, the discharge of the steam is prevented whereby the steam may not be smoothly fed to a room. Accordingly, it is necessary to consider an improvement.

In the preparation of the container of the electrode type steam vaporizer, it is necessary to have an airtight structure except the connection of the electrode unit and the water inlet. Accordingly, it is preferable to prepare the container by blow-molding in one piece. However, it is difficult to prepare the container having a complicated structure in one piece by blow-molding. Accordingly, the container is prepared by molding an upper body and a lower body and bonding them with an adhesive composition. However, the bonding with an adhesive composition causes low adhesive strength and low airtightness. Accordingly, it has been considered to bond the upper body and the lower body by a rotary friction melt-bonding which is the method of immediately bonding with friction heat, two parts made of thermoplastic resin having a circular bonding surface under high speed rotation whereby high adhesive strength and high airtightness can be attained.

In conventional rotary friction melt-bonding, the bonding surfaces of the upper body 64 and the lower body 65 are contacted with each other without any space, and resin scraps 70 are deposited at the peripheral part of the bonding surfaces by the rotary friction melt-bonding (see FIG. 11) whereby the appearance is inferior and a scrap removing step is needed, thereby causing inferior processability.

SUMMARY OF THE INVENTION

It is an object of the present invention to provide an electrode type steam vaporizer which overcomes the above-described disadvantages to result in a structure which permits the supply of water and the disassembly of an electrode unit when passing a current so as to prevent an accidental electric shock and to improve safety.

It is another object of the present invention to provide an electrode type steam vaporizer which can prevent an accident caused by the closing of a steam nozzle or a steam outlet to increase steam pressure.

It is the other object of the present invention to provide a method of manufacturing the container of an electrode type steam vaporizer.

The foregoing and other objects of the present invention can be attained by providing an electrode type steam vaporizer having a container body which is usable as a water receptacle. According to the present invention, a top surface of the vaporizer container body has a water inlet and is covered by a cover so that it is impossible to add water to the container when the cover is in position. The cover contains a concave portion having an aperture which exposes a power source connection of the electrode. A power source connector is shaped so that it can be inserted into the concave portion and can connect with the power source connector when the cover is at the proper angular position. Once the power source connector is connected to the power source connection, it is impossible to remove the cover from the container since the power source connector locks the cover into position. In addition, the power source connector cannot be inserted into the power source connection unless the cover is in position because a stopper pin in the power source connector is normally in an extended blocking position where it contacts a stopper projection to prevent the power source connector from connecting with the power source connection. However, a tapered ridge on the cover provides a stop release by raising the stopper pin out of the contact position with the stopper projection when the power source connector is inserted at a time when the cover is on and in the proper angular position. Therefore, it is impossible to add water to the container when the cover is on and it is further impossible to insert the power source connector unless the cover is on and in position. Therefore, it is impossible to add water to the container when the electrodes are energized.

In the electrode type steam vaporizer, the steam nozzle is formed by a cylindrical outer wall and a concave inner wwall which is eccentric with respect to the axis of the cylindrical outer wall. The inner and outer walls merge at a top surface which is curved so that the surface is higher on one circumferential portion thereof than on another. Therefore, when a book or a similar planar object covers the steam nozzle a space remains for the escape of the steam so that there is no steam pressure build up. The nozzle openings are located in the bottom of the concave defined by the inner wall and are located on a bulging or convex surface at the bottom of the concave portion. This convex surface prevents small objects such as a marble or ball from blocking the steam outlet. Finally, projections are positioned adjacent the steam outlets and extending in a downward direction for permitting condensed water to drain rather than clogging the steam outlets.

The container body is formed by bonding a first lower body and a second upper body by rotary friction melt-bonding while forming a space for receiving resin scraps between the bonding surfaces of the upper body and the lower body.

BRIEF DESCRIPTION OF THE DRAWINGS

FIG. 1 is a schematic view of one embodiment of the electrode type steam vaporizer according to the present invention;

FIG. 2 is a sectional view of the steam vaporizer of FIG. 1;

FIG. 8 is a plan view of a steam nozzle used in the embodiment;

FIG. 8A is a bottom view of the steam nozzle of FIG. 8;

FIG. 9 is a sectional view taken along the line IV—IV of FIG. 8;

FIG. 10 is a sectional view of one embodiment of the container of the electrode type steam vaporizer;

FIG. 11 is a partially enlarged sectional view of the bonding part for showing resin scraps formed by the conventional resin melt-bonding method;

FIG. 12 is a partially enlarged sectional view of one embodiment of the bonding part formed by the resin melt-bonding method of the present invention;

FIG. 13 is a partially enlarged sectional view of another embodiment of the bonding part; and FIG. 14 is a partially enlarged sectional view of the other embodiment of the bonding part.

DETAILED DESCRIPTION OF THE PREFERRED EMBODIMENTS

Figure 3:
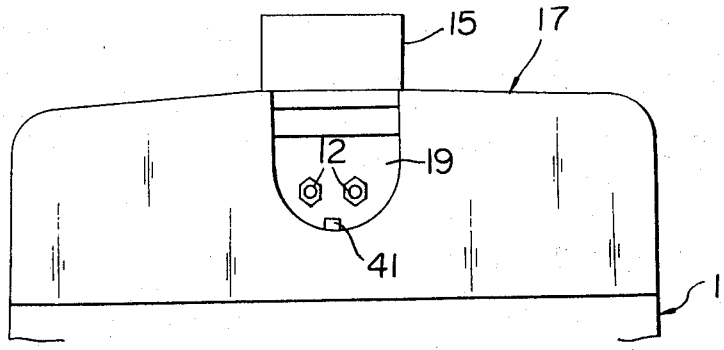
FIG. 3 is a partial front view of the steam vaporizer of FIG. 1.
Figure 4:
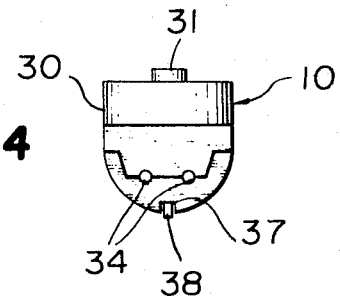
FIG. 4 is a front view of a power source connector used in the embodiment.

Referring to the drawings, certain embodiments of the electrode type steam vaporizer of the present invention will be illustrated.

In FIGS. 1 to 4, an opening (2) for connecting an electrode unit and a water input (3) are formed at the upper central part of a container body (1) such as a water receptacle. An electrode unit (5) having a pair of ferrite electrodes (4) is connected to the opening (2). A water feed cap (6) detachably covers on the water inlet (3). The electrode unit (5) comprises a cylindrical housing (8) having a flange (7) at the peripheral part and an inner cylindrical housing (9) formed in one piece at the inner side of the cylindrical housing (8). A rectangular concave portion (11) for receiving a power source connector (10) is formed on the cylindrical housing above the flange. A pair of pins (12) for connection are disposed in the rectangular concave portion (11) and the pins (12) are extended in the cylindrical housing (8) to connect them to the ferrite electrodes (4). The flange (7) of the electrode unit (5) is fixed to the container body (1) with screws (13).

A steam nozzle (15) having a steam outlet (14) is provided above the electrode unit (5). The lower part of the steam nozzle (15) is matched with the opening (16) of the cylindrical housing (8). A cover (17) covers the upper part of the container body (1) while the steam nozzle (15) projects through the central aperture (18). An upper concave portion (19) which is radially extended from the central aperture (18) to the peripheral part and has constant depth, is formed at a part of the upper surface of the cover (17).

The upper concave portion (19) is a plug-in aperture for the power source connector (10). The cover (17) can be turnable for a certain angle with respect to the container body (1) the angle belong limited by securement 170. When the cover is turned in the arrow line direction A in FIG. 1, the cover can be detached from the container body (1) to open the container and the cover can be secured to the container by turning the cover in the opposite direction. The fact can be shown by indicating "open" or "close" on the open-close indicator (21) through the indication hole (20) formed on the cover (17).

Figure 5:
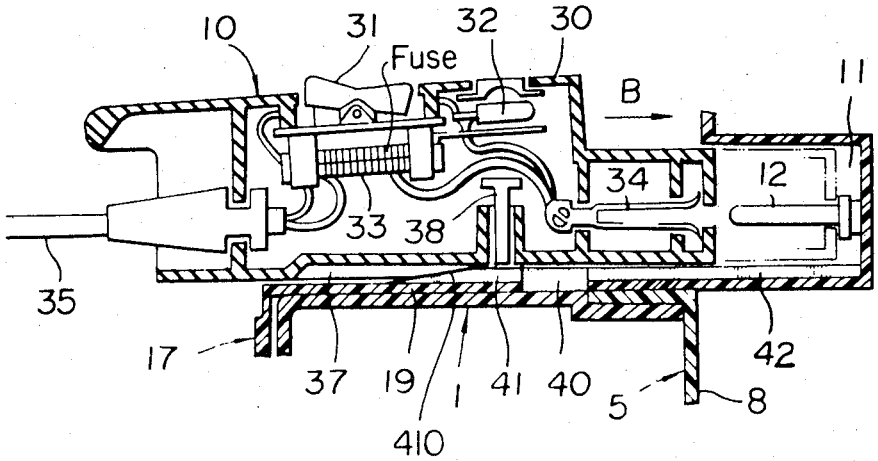
FIG. 5 is a partially enlarged sectional view of the power source connector with the cover in closing position.
Figure 6:
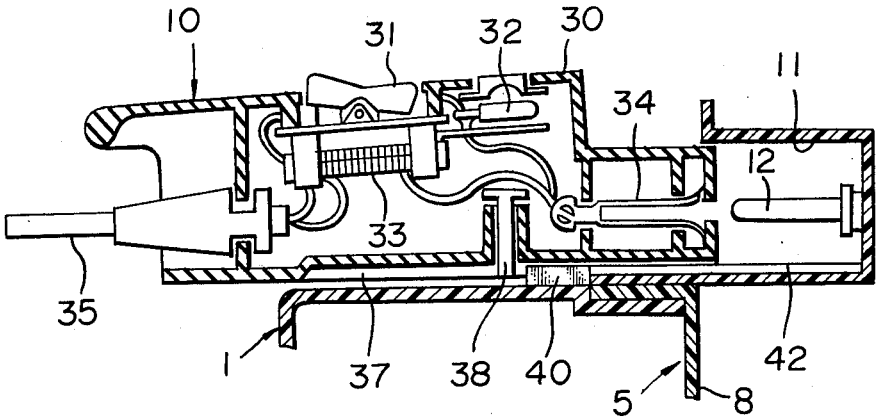
FIG. 6 is a view similar to FIG. 5 but with the cover in an open position.

On the other hand, as shown in FIGS. 5 and 6, the power source connector (10) comprises a switch (31), a lamp (32) for indicating the current condition and a fuse (33) in a casing (30). A pair of sockets (34) for connection with the pins (12) at the side of the electrode unit (5) are formed at the front part of the casing (30). Wires (35) for connecting to the power source lead out from the rear part of the casing (30) and a plug (36) is connected at the end of the wires. The bottom of the casing (30) has semi-circular shape and a guide groove (37)

formed in the longitudinal direction of the casing (30) at the central part and a stopper pin (38) is held in vertically shiftable condition in the guide groove (37). A stopper projection (40) which is contacted by the stopper pin (38) in the projected condition, is formed on the upper surface of the container body (1).

A tapered ridge (41) having taper 410 and being higher towards the plug-in direction of the power source connector is formed at the upper concave portion (19) of the cover (17). A guide ridge (42) is formed at the bottom surface of the rectangular concave portion (11) and the guide ridge is fittable to the guide groove (37) to control the plug-in direction of the power source connector (10).

In the structure, in order to feed water into the container body (1), the power source connector (10) and the cover (17) are disassembled and the water supply cap (6) is detached and water is fed through the water inlet (3). After feeding water, the water supply cap (6) is reattached to the water inlet (3) and the cover (17) is positioned on the container body and turned to the direction of "close" so as to be secured to the container body (1), the power source connector (10) is inserted in the arrow line direction B as shown in FIG. 5, the socket (34) is connected to the pins (12) for connection, the plug (36) is connected to a commercial power source and the switch (31) is turned on for operation. In such case, when the cover (17) is secured on the container body (1) at a predetermined position, the tapered ridge (41), the stopper projection (40) and the guide ridge (42) are aligned as shown in FIG. 5 whereby the stopper pin (38) is raised along the slant surface (410) of the tapered ridge (41) to pass over the stopper projection (40) without being hooked by the projection and the front part of the power source connector can be smoothly inserted to the position shown by the two dot chain line. As a result, the socket (34) can be contacted with the pins (12) for connection. In the condition where the power source connector (10) is inserted and the upper concave portion (19) of the cover (17) is pushed adjacent to the container body (1), the cover (17) can not be removed. The front part of the power source connector 10 fits into concavity 11 in the electrode unit while the rear part of the power source connector 10 is received in the concavity 19 of the cover. This prevents the rotation of the cover and the removal thereof.

On the other hand, as shown in FIG. 6, even though an attempt is made to insert the power source connector (10) into the rectangular concave portion (11) of the electrode unit (5) without installing the cover (17), stopper pin (38) projected by gravity is contacted with the stopper projection (40) to prevent the plug-in.

As described above, in accordance with the embodiment of the present invention, operation can not be attained without fitting the cover (17) at the predetermined position. On the other hand, the cover (17) can not be removed when the power source connector 10 is connected to the pins 12. Accordingly it is possible to prevent, without failure, an accident of electric shock caused by feeding water or cleaning the electrode unit (5) while passing the current. Moreover, it is unnecessary to disassemble the electrode unit (5) for feeding water. Accordingly, the structure of the steam vaporizer is remarkably advantageous in the case of using ferrite electrodes (4) which are not corroded by a chemical reaction but are easily broken, and the possibility of damage of the electrodes can be minimized.

In the conventional electrode type steam vaporizer, a concavo-convex part is formed at the upper surface thereof, whereby it is not easy to clean the concavo-convex part when dust is deposited. However, in the present invention, the cover (17) forms a simple outer shape whereby the dust deposited on the cover can be easily removed.

When the steam vaporizer is not used for a long time, the cover (17) is turned for a small angle to seal the pins (12) for connection of the electrode unit (5) with the cover (17) whereby the dust deposition on the pins (12) for connection can be prevented.

In the embodiment, the stopper projection (40) as the second stopper is formed on the upper surface of the container body (1). In a modification, the stopper projection (40) can be formed at the bottom surface of the rectangular concave portion (11). The fitting of the cover to the container body with the power source connector can be modified as desired. In the electrode type steam vaporizer of the present invention, it is preferable to use anticorrosive ferrite electrodes. However, it is possible to use the other electrodes made of stainless steel etc. for a steam vaporizer used for a few times while requiring only a small number of cleanings of the electrodes.

As described above, in accordance with the embodiment, the water supply and the disassembly of the electrode unit are prevented during passing the current thereby preventing an accidental of electric shock and improving the safety.

The other embodiment of the electrode type steam vaporizer of the present invention will be described.

Figure 7:
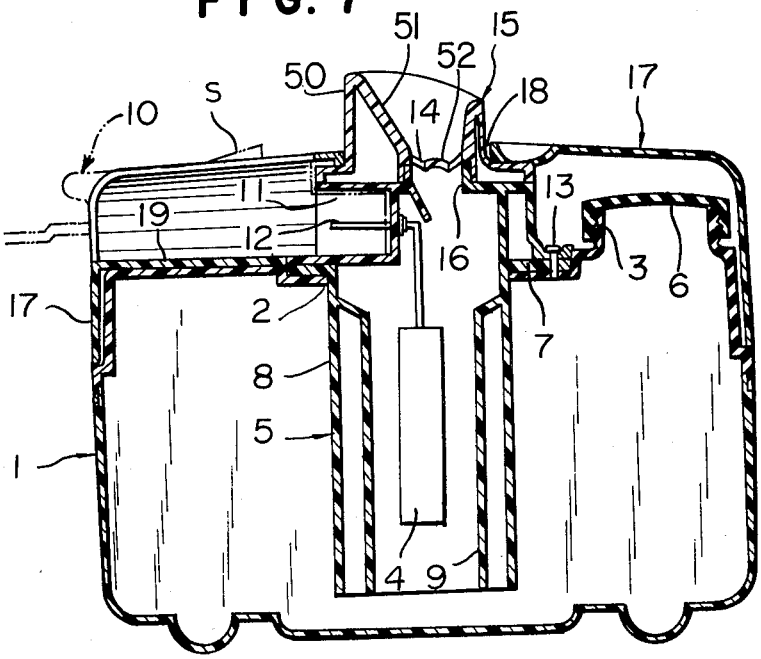
FIG. 7 is a sectional view of the other embodiment of the electrode type steam vaporizer according to the present invention.

FIG. 7 shows a whole structure of the embodiment. In FIG. 7, the opening (2) for connecting the electrode unit and the water inlet (3) is formed at the upper central part of the container body (1) forming a water receptacle. The electrode unit (5) comprising a pair of ferrite electrodes (4) is connected to the opening (2). The water feed cap (6) is detachably covering the water inlet (3). The electrode unit (5) comprises the cylindrical housing (8) having the flange (7) at the peripheral part and the inner cylindrical housing (9) formed in one piece at the inner side of the cylindrical housing (8). The rectangular concave portion (11) for fitting a power source connector (10) is formed on the cylindrical housing (8) above the flange. The pair of pins (12) for connection are disposed in the rectangular concave portion (11) and the pins (12) are extended into the cylindrical housing (8) to connect them to the ferrite electrodes (4). The flange (7) of the electrode unit (5) is fixed to the container body (1) with screws (13).

The steam nozzle (15) having the steam outlet (14) is provided above the electrode unit (5). The lower part of the steam nozzle (15) is matched with the opening (16) of the cylindrical housing (8).

In FIGS. 8A and 9, the detail of the steam nozzle (15) is shown. As it is clear from the drawings, the steam nozzle (15) comprises a cylindrical wall (50) and an eccentric inner concavo part (51) formed in one piece. A convex (52) is formed at a central position on the bottom of the eccentric inner concavo part (51) and a plurality of steam outlets (14) are formed around the convex (52). A plurality of projections (53) are formed at the rear surface of the bottom near the steam outlets (14). The upper edge (54) of the cylindrical wall (50) has a curved slant surface as shown in FIG. 9.

The cover (17) covers the upper part of the container body (1) with the steam nozzle (15) projecting through the central aperture (18). The upper concave portion (19) which is radially extended from the central aperture (18) to the peripheral part and has constant depth, is formed at a part of the upper surface of the cover (17). The upper concave portion (19) is a plug-in aperture for the power source connector (10). The power source connector (10) comprises a switch and a fuse and it can be inserted into the rectangular concave portion (11) of the electrode unit (5) and it can be connected to the pins (12) for connection only when the cover (17) covers the container body (1) at the predetermined position.

In said structure, the power source connector (10) and the cover (17) are disassembled and water is fed through the water inlet (3) into the container body (1), the cover (17) is replaced on the container body (1), the power source connector (10) is connected to the electrode unit (5), the current is passed to operate the steam vaporizer. Steam is vaporized about several to ten minutes after passing the current and steam is discharged through the steam outlet (14) formed in the steam nozzle (15). In this case, a part of steam is cooled to condense into water drops which are adhered around the steam outlet (14). However, the condensed water drops fall down along the projections (53) formed on the rear surface of the bottom near the steam outlets (14). Accordingly, the formation of water film caused by surface tension of the water drops at the steam outlet (14) is prevented.

Even though the water film is formed, it is broken by the projections (53) whereby the discharge of steam can be smoothly attained.

Even though a book (P) is carelessly put on the steam nozzle in the operation as shown by the two dot chain line of FIG. 9, the opening of the steam nozzle (15) is not completely closed because the upper edge (54) of the cylindrical wall (50) has a curved slant surface.

Even though a small ball for pachinko play etc. falls into the concavo part (51) of the steam nozzle (15) by careless conduct in the operation, the steam outlets (14) are not clogged by the small ball, because the steam outlets (14) are formed at a central position of the concavo part (51).

The convex (52) at the bottom is formed to prevent such trouble without failure. As the result, a gap is formed between the small ball and the steam outlets (14) and a plurality of the steam outlets are formed whereby the abnormal increase of steam pressure can be prevented without failure.

As described above, in accordance with the embodiment, the following advantages can be expected.

(1) The projections (53) are formed on the rear surface of the bottom near the steam outlets, whereby the clogging of the steam outlets (14) with water drops can be prevented and steam can be smoothly discharged.

(2) The upper edge (54) of the cylindrical wall of the steam nozzle (15) is formed in a curved slant surface whereby the steam nozzle (15) is not closed by book, paper, plate etc. and the abnormal increase of steam pressure can be prevented.

(3) The steam outlets (14) are formed at a central position of the concavo part (51), whereby the clogging of the steam outlet (14) caused by a small ball, can be prevented. Accordingly, the abnormal increase of steam pressure can be prevented.

The number of the steam outlets can be as desired and it can be a single outlet. The number of projections can be also as desired.

As described above, in accordance with the embodiment of the electrode type steam vaporizer, the accident caused by the increase of steam pressure caused by closing or clogging the steam nozzle or the steam outlet can be prevented and steam can be smoothly discharged.

The other embodiment of the manufacture of the container body will be described referring to FIGS. 10 to 14.

FIG. 10 shows a sectional view of the container body and FIG. 11 shows the bonded part prepared by the conventional rotary friction melt-bonding method as described above in the description of the prior art.

FIG. 12 shows a sectional view of the bonded part prepared by the method of the present invention.

In FIG. 12, an upper body (64) and a lower body (65) are made of synthetic resin and the bonding parts thereof respectively have circular shapes.

The bonding surfaces (64A), (64B) of the upper body (64) and the bonding surfaces (65A), (65B) of the lower body (65) are separated before applying the rotary friction melt-bonding method. A space (71) along the peripheral surfaces and an inner space (72) are formed between them. Accordingly, scrap produced in the rotary friction melt-bonding method is held in the inner space (72) without squeezing out on the peripheral surface. It is necessary to fill the space (71) or to maintain the space (71) after the rotary friction melt-bonding. When the rotary friction melt-bonding operation is continued after filling the spaces and the bonding surfaces (64), (65) are directly treated, the effect of the space (71) is lost by squeezing out the scrap on the peripheral surface.

In accordance with the first embodiment, the space (71) and the space (72) are formed between the bonding surfaces (64A), (64B) and (65A), (65B) at peripheral side whereby the scrap formed in the rotary friction melt-bonding is held in the space (72) and the step of removing scrap can be eliminated. As a result, the container body having excellent adhesive strength and airtightness can be prepared with high productivity.

FIG. 13 shows the second embodiment of a method for manufacturing the container body.

In FIG. 13, the bonding surfaces (64C), (64D), (64E) of the upper body (64) and the bonding surfaces (65C), (65D), (65E) of the lower body (65) are separated before applying the rotary friction melt-bonding method. The V groove (64F) is formed on the bonding surface of the upper body (64). Accordingly, a space (73) along the peripheral surfaces and an inner space (74) and a space (75) along the inner surfaces are formed between the upper body (64) and the lower body (65). The scrap formed in the rotary friction melt-bonding method is held in the space (74) without squeezing out the peripheral surfaces. Since the space (75) is formed at the inner surfaces, the squeeze-out of the scrap on the inner surfaces can be also prevented.

FIG. 14 shows the third embodiment of a method for manufacturing the container body. In FIG. 14, the bonding surfaces (64G), (64H), (64J) of the upper body (64) and the bonding surfaces (65G), (65H), (65J) of the lower body (65) are separated before applying the rotary friction melt-bonding method. The U groove (65L) is formed on the bonding surface of the lower body (65). Accordingly, a space (76) along the peripheral surfaces and an inner space (77) and a space (78) along the inner surfaces are formed between the upper body (64) and the lower body (65). The scrap formed in the rotary friction melt-bonding method is held in the space (77)

without squeezing out to the peripheral surfaces. Since the space (78) is also formed at the inner surface as in the second embodiment, the squeeze-out of the scrap on the inner surfaces is prevent.

In the embodiments, the preparation of the container body is illustrated. However, the same method can be applied for bonding two synthetic resin substrates.

In accordance with the embodiment, the squeeze-out of the scrap on the peripheral surface can be prevented in the bonding of resin substrates whereby the step of removing the scrap can be eliminated to improve the productivity.

What is claimed as new and desired to be secured by Letters Patent of the United States is:

1. An electrode type steam vaporizer comprising:
- a container body forming a water receptacle, said container body including a surface;
- an electrode unit having one end extending into said container body and fittable into an aperture of said surface and another end extending from said container body, said electrode unit including a power source connection external of and adjacent to said body for supplying power to said electrode unit whereby said water in said receptacle is vaporized;
- a steam nozzle formed on the other end of said electrode unit;
- a removable power source connector adapted to be connected to said power source connection;
- a water inlet on said surface;
- a cover member covering said surface, said cover including a portion adapted to receive said removable power source connector and to provide access for said power source connector to said power source connection of said electrode unit, wherein said cover member includes an aperture through which said power source connector extends when connected to said power source connection, said cover member and said power source connector cooperating to prevent said cover from being removed from said container body when said power source connector and said power source connection are connected together;
- cooperable releasable stopper means on said power source connector and one of said container body surface and said electrode unit for preventing the connection of said power source connector to the power source connection of said electrode unit; and
- a stopper means releasing means on said portion of said cover member, said releasing means adapted to contact and release said releasable stopper means when said power source connector is inserted into said portion of said cover and said cover member is enclosing said surface.

2. The vaporizer of claim 1 wherein said releasable stopper means comprises:
- a stopper pin extending from said power source connector and movable from an extended stopping position to a retracted non-stopping position; and
- a stopper projection on at least one of said surface of said container body and said electrode unit adjacent said power source connection, said stopper projection being positioned to contact and stop the movement of said power source connector towards said power source connection when said stopper pin is in said extended position;

and wherein said stopper releasing means comprises:
- a releasing projection on said cover member, said releasing projection including a stopper pin retracting portion, being positioned to contact and retract said stopper pin during movement of said power source connector towards said power source connection when said cover member covers said surface of said container body.

3. The vaporizer of claim 1 wherein said steam nozzle comprises:
- an outer cylinder having one end extending to said electrode unit, the other end of said cylinder defining a non-planar edge;,
- a concave surface extending from said other end towards said one end; and at least one steam outlet in said concave surface.

4. The vaporizer of claim 3 wherein said edge forms a convex surface in cross section.

5. The vaporizer of claim 3 wherein said concave surface is eccentric with respect to said cylinder, and said at least one steam outlet is positioned in a central portion of said concave surface.

6. The vaporizer of claim 5 wherein a convex surface is formed at a central portion of said concave surface, said at least one steam outlet being located off of said convex surface.

7. The vaporizer of claim 5 wherein at least one projection is formed in said steam nozzle on the surface of said concave surface opposite said non planar edge and adjacent each said at least one steam outlet.

* * * * *

UNITED STATES PATENT AND TRADEMARK OFFICE

CERTIFICATE OF CORRECTION

PATENT NO. : 4,288,684

DATED : Sep. 8, 1981

INVENTOR(S) : HISAO KATOU ET AL

It is certified that error appears in the above-identified patent and that said Letters Patent are hereby corrected as shown below:

Please insert the following Assignee Information:

[73]---Assignee:

TDK Electronics Co., Ltd., Tokyo, Japan ---.

Signed and Sealed this

*Twelfth* Day of *January 1982*

[SEAL]

*Attest:*

GERALD J. MOSSINGHOFF

*Attesting Officer*

*Commissioner of Patents and Trademarks*